US006660701B1

(12) United States Patent
Degroot

(10) Patent No.: US 6,660,701 B1
(45) Date of Patent: Dec. 9, 2003

(54) STABILIZED SOLVENT SYSTEM FOR CLEANING AND DRYING

(75) Inventor: Richard Degroot, W. Lafayette, IN (US)

(73) Assignee: Polysystems USA, Inc., Bayonne, NJ (US)

( * ) Notice: Subject to any disclaimer, the term of this patent is extended or adjusted under 35 U.S.C. 154(b) by 215 days.

(21) Appl. No.: 10/027,857

(22) Filed: Oct. 22, 2001

Related U.S. Application Data

(60) Provisional application No. 60/242,362, filed on Oct. 23, 2000.

(51) Int. Cl.[7] ..... C11D 7/52

(52) U.S. Cl. ..... 510/177; 510/175; 510/178; 510/255; 510/273; 510/365; 510/408; 510/409; 510/412; 134/3

(58) Field of Search ..... 510/178, 175, 510/409, 411, 412, 177, 506, 410, 255, 273, 365, 408; 134/3

(56) References Cited

U.S. PATENT DOCUMENTS

| | | | | |
|---|---|---|---|---|
| 3,564,061 A | | 2/1971 | Correia et al. | |
| 4,018,837 A | | 4/1977 | Archer et al. | |
| 4,594,177 A | | 6/1986 | Lantz et al. | |
| 4,618,447 A | | 10/1986 | Seelig | |
| 5,256,329 A | | 10/1993 | Li et al. | |
| 5,403,507 A | * | 4/1995 | Henry | 510/365 |
| 5,492,645 A | * | 2/1996 | Oshima et al. | 510/412 |
| 5,514,301 A | | 5/1996 | Bil et al. | |
| 5,616,549 A | | 4/1997 | Clark | |
| 5,665,170 A | * | 9/1997 | Lee et al. | 134/19 |
| 5,665,172 A | * | 9/1997 | Oshima et al. | 134/40 |
| 5,679,632 A | * | 10/1997 | Lee et al. | 510/412 |
| 5,690,862 A | * | 11/1997 | Moore et al. | 252/364 |
| 5,707,954 A | | 1/1998 | Lee | |
| 5,792,277 A | * | 8/1998 | Shubkin et al. | 134/19 |
| 5,824,162 A | | 10/1998 | Clark | |
| 5,846,923 A | | 12/1998 | Reierson | |
| 5,858,953 A | | 1/1999 | Aman et al. | |
| 6,010,997 A | | 1/2000 | Thenappan et al. | |
| 6,048,832 A | | 4/2000 | Thenappan et al. | |
| 6,048,833 A | * | 4/2000 | DeGroot | 510/412 |
| 6,063,749 A | * | 5/2000 | DeGroot | 510/412 |
| 6,365,565 B1 | * | 4/2002 | Thenappan et al. | 510/411 |

* cited by examiner

*Primary Examiner*—Gregory E. Webb
(74) *Attorney, Agent, or Firm*—Michael E. Zall

(57) ABSTRACT

This invention relates to improved stabilizing compositions for n-propyl bromide. More particularly, the cleaning composition includes about 0.1 to 5% Butylene oxide, about 0.1 to 5.0% t-butanol, about 0.1 to 5% acetonitrile, about 0.1 to 5% nitromethane; and the remainder n-propyl bromide. These mixtures are useful as cleaning solvents for the electronic, aerospace, and general manufacturing industries, especially in the area of vapor degreasing.

4 Claims, 2 Drawing Sheets

STABILIZED SOLVENT SYSTEM FOR CLEANING AND DRYING

RELATED APPLICATIONS

This application claims the benefit of Provisional Application U.S. Serial No. 60/242,362 filed Oct. 23, 2000, the entire disclosure of which is incorporated herein by reference.

BACKGROUND OF THE INVENTION

1. Field of the Invention

This invention relates to an improved stabilized solvent composition. More particularly, this invention relates to compositions, which include a volatile solvent component n-propyl bromide, and one or more non-volatile additives that have the capability of preventing breakdown of the solvent molecules with various reactive metals.

2. Prior Art

The production of many electrical and mechanical parts generally require a final step of cleaning the part prior to final assembly. Traditionally this cleaning process employed chlorinated, fluorinated, or a combination of chlorinated and fluorinated solvents. Such solvents, e.g., 1,1,1-trichloroethane and 112-trichloro, 221-triflouroethane,are not favored today because of environmental concerns, Recently it has been recognized that n-propyl bromide is an environmentally friendly alternative to these solvents. Its primary advantage is that it can be used in traditional cleaning applications such as vapor degreasing, aerosols, wipes, etc. without any detrimental effect to the environment.

However, like many chlorinated solvents, n-propyl bromide will react with various reactive metals, in particular aluminum and its alloys. N-propyl bromide has an advantage over 1,1,1-trichloroethane, which was traditionally used to clean aluminum parts, in that such reaction occurs at a much slower rate. For example, 1,1,1-trichlorethane will react almost immediately with aluminum whereas n-propyl bromide will only begin to react with aluminum after about 10 minutes of contact time.

Although n-propyl bromide reacts slower in contact with aluminum, the existence of such a reaction, regardless of the reaction time, necessitates the use of various "stabilizers" in cleaning compositions containing n-propyl bromide to inhibit the reaction between n-propyl bromide and reactive metals. Many of the stabilizer packages developed to stabilize n-propyl bromide were substantially similar to the stabilizer packages used with chlorinated solvents, in particular those used with 1,1,1-trichoroethane. However, it has been found that many stabilizers that showed efficacy when used with 1,1,1-trichloroethane showed little, if any efficacy in stabilizing n-propyl bromide Many of the prior art stabilizer compositions suffer from a number of disadvantages, which limit their usefulness for today's applications. For example, some known volatile stabilized solvent compositions have often proved less than satisfactory due to the ineffective stabilization against water because of their high water solubility, which can come from high humidity conditions. Also, although some known compositions have proven effective to stabilize solvent formulations, they have not been practical in use when solvent losses are minimized. Also, many prior art stabilizer compositions use solvents that deplete the ozone layer, contribute significantly to global warming, are economically unfeasible and/or are too toxic (very low TLVs). Another relatively serious problem associated with the use of known stabilized solvent compositions, which is dependant on the specific application and substrates to be dried, is that such solutions tend to deplete or get used up. This requires the operator to constantly evaluate the solutions resulting in equipment and/or processing down time or worse, if they are not monitored carefully, erosion of the equipment and/or the substrates by the acidic solutions produced. Such acidic conditions can cause corrosion of the cooling and heating coils and inner parts of the machine as well as corrosion of the substrates being treated. Such an unstable situation caused by such acidity interrupts and delays the cleaning process. The equipment must then be drained and all the parts neutralized prior to recharging the system with fresh solvent. Further, the acidified solvent, which is typically caused by the formation of hydrogen bromide, must be neutralized and disposed of properly. U.S. Patents of general interest are:

U.S. Pat. No. 6,048,832 to Thenappan describes azeotrope-like compositions of 1-bromopropane, 4-methoxy-1,1,1,2,2,3,3,4,4-nonafluorobutane (HFE-7100) and at least one organic solvent selected from the group consisting of methanol, ethanol, 2-propanol, 2-methyl-2-propanol, tetrahydrofuran, nitromethane, and methylene chloride and more particularly to azeotrope-like compositions based on these compounds which are useful as solvents in refrigeration flushing, oxygen system cleaning and vapor degreasing applications.

U.S. Pat. No. 6,010,997 to Thenappan et al describes compositions of 1-bromopropane, nitromethane or acetonitrile and at least one alcohol selected from the group consisting of ethanol, 2-propanol and 2-methyl-2-propanol and more that form azeotrope-like compositions which are useful as solvents in refrigeration flushing, oxygen system cleaning and vapor degreasing applications.

U.S. Pat. No. 5,858,953 to Aman et al. describe a 1-bromopropane composition that stays stable even though repeatedly used at high temperatures over an extended period of time as in vapor degreasing. The stabilized 1-bromopropane compositions comprises 100 parts by weight of 1-bromopropane, from 0.1 to 5 parts by weight of nitromethane, and from 0.1 to 5 parts by weight of 1,2-butylene oxide or trimethoxymethane.

U.S. Pat. No. 5,846,923 to Reierson describes a surfactant composition comprising poly (alkylamine bis-ethoyxylate phosphates).

U.S. Pat. Nos. 5,824,162 and 5,616,549 to Clark describe a solvent mixture comprising n-propyl bromide, a mixture of terpenes and a mixture of low boiling solvents, and a method for cleaning an article (e.g., an electrical, plastic, and metal parts) in a vapor degreaser using the solvent mixture.

U.S. Pat. No. 5,792,277 to Shiubkin et al. describes a stabilized cleaning composition that contains n-propyl bromide. The cleaning solvent compositions includes an alcohol selected from 1-propanol and 2-butanol, including mixtures thereof, as a co-solvent so as to form azeotropic or azeotropic-like mixtures which have no fire or flash points.

U.S. Pat. No. 5,707,954 to Lee describes a stabilized solvent composition which is comprised of: a solvent portion which includes at least 90 wt % n-propyl bromide; and a 1,4-dioxane-free stabilizer system which includes 2,2-dialkoxypropane in which each alkoxy group independently contains up to 3 carbon atoms. The solvent composition is useful as a degreaser and cleaner in both cold and vapor cleaning systems.

U.S. Pat. No. 5,690,862 to Moore, Jr. et al. describes a solvent system that is non-flammable. The system comprises a hydrocarbon solvent having a flash point less than about 38° C. and another solvent containing at least 90-wt % n-propyl bromide.

U.S. Pat. No. 5,679,632 to Lee et al. describes a solvent system and process for cleaning cellulose triacetate polymer camera film. The solvent system comprises n-propyl bromide and a mix of an alkyl bromide in which the alkyl group contains 4 to 7 carbon atoms and an alkane containing 6 to 7 carbon atoms.

U.S. Pat. No. 5,665,170 to Lee et al describes a non-stabilized or at least only lightly stabilized n-propyl bromide-based solvent system which is suitable for use in the presence of metals which normally and easily catalyze the dehydrobromination of brominated hydrocarbons, such as isopropyl bromide.

U.S. Pat. No. 5,665,172 to Oshima describes deterring solvent that essentially consists of (A) a brominated hydrocarbon of the formula: $C_nH_{2n+}$ 1Br wherein n represents a number of 3 or above and/or a brominated hydrocarbon of the formula: $C_mH_{2m-1}Br$ wherein m represents a number of 2 or above. The solvent composition comprises the above-described solvent (A) and a stabilizer selected from the group consisting of nitroalkanes, ethers, epoxides and amines.

U.S. Pat. No. 5,514,301 to Bil et al. describes dewetting or degreasing compositions based on halogenated aliphatic solvents containing in solution at least one mono- or dialkyl phosphate of a fluorinated amine, at least one quaternary ammonium mono- or dialkylphosphate and optionally a quaternary ammonium chloride.

U.S. Pat. No. 5,492,645 to Oshima et al. describes a deterging solvent containing a brominated hydrocarbon of the formula: $C_nH_{2n+}$ 1Br wherein n represents a number of 3 or above and/or a brominated hydrocarbon of the formula: $C_mH_{2m-1}Br$ wherein m represents a number of 2 or above. The composition also contains a stabilizer selected from the group consisting of nitroalkanes, ethers, epoxides and amines. The solvent composition is described as stable, having a deterging effect and usable as a substitute for "flon" and chlorine solvents.

U.S. Pat. No. 5,403,507 to Henry describes a solvent mixture for use in vapor cleaning degreasing systems containing dibromomethane, instead of such high ozone depleting chlorofluorocarbons as Freon and 1,1,1 Trichloroethane, mixed with other solvents including a number of low boiling solvents which prevent the mixture from becoming acidic on the release of bromine into the atmosphere.

U.S. Pat. No. 5,256,329 to Li et al. describes drying agent compositions comprising a volatile hydrochlorofluorocarbon such as 1,1-dichloro-1-fluoroethane and demulsifer.

U.S. Pat. No. 4,618,447 to Seelig describes drying compositions comprising a volatile halocarbon and one or more aromatic quaternary ammonium salts of a phosphate ester, and methods of using such compositions for cleaning and/or drying non-absorbent articles.

U.S. Pat. No. 4,594,177 to Lantz et al. describes a demoisturizing composition used for the displacement of liquid water, comprising a chlorofluorocarbon that is liquid at room temperature, and a surface-active agent.

U.S. Pat. No. 4,018,837 to Archer et al. describes a stable 1,1,1-trichloroethane composition containing 1,1,1-trichloroethane, and, as the essential acid acceptor, 0.25 to 1 weight percent of a C4-8 monoepoxide, epichlorohydrin or a mixture of such epoxides and, as the essential stabilizer against metal-induced decomposition, 3.5 to 4.5 weight percent of a three-component system selected from the group consisting of dioxane, trioxane, and dioxolane, t-butyl alcohol, a C1-3 nitroalkane or mixtures of nitroalkanes, in specific proportions. When a nitroalkane is not present as a member of the three-component mixture, it is added in an amount to provide from about 0.25 to 1 percent by weight of said nitromethane. These compositions are said to be stable in the presence of aluminum, zinc, iron, copper and their alloys, both in the liquid and vapor state of the compositions.

U.S. Pat. No. 3,564,061 to Correia et al. describes chlorinated or brominated alkenes containing 2–4 carbon atoms stabilized with trimethyl orthoformate and a compound selected from the group consisting of C1–C4 alkanols, C1–C4 alkyl cyanides, 1,4-dioxane, trioxane and C1–C4 nitroalkanes.

There is therefore a need for an improved non-volatile stabilized solvent composition, which does not decompose in the presence of metals.

OBJECTS AND SUMMARY OF THE INVENTION

It is an object of this invention to provide a stabilized n-propyl bromide cleaning composition that does not suffer from a number of disadvantages which limit the usefulness of the known compositions.

It is a further object of this invention to provide a stabilized cleaning composition that provides effective stabilization against water.

It is still another object of this invention to provide a stabilized cleaning composition that is practical to use when solvent losses are minimized.

It is yet another object of this invention to provide a stabilized cleaning composition that does not deplete the ozone layer or contribute significantly to global warming, is economical to use and is not toxic (very low TLVs).

It is still another object of this invention to provide a stabilized cleaning composition that does not substantially deplete or get used up and does not require constant monitoring during use.

The cleaning compositions of this invention consists essentially of:

about 0.1 to 5% butylene oxide, about 0.1 to 5.0% t-butanol, about 0.1 to 5% acetonitrile, about 0.1 to 5% nitromethane, and the remainder n-propyl bromide.

All compositions are in weight percent.

BRIEF DESCRIPTIONS OF THE FIGURES

DESCRIPTION OF INVENTION

The present invention utilizes a unique blend of stabilizers and is superior to those currently used by manufacturers of n-propyl bromide stabilized compositions. This cleaning composition blend is effectively stabilized when used on common metals such as aluminum, iron, zinc, and copper.

Extensive studies by the inventor have shown that an n-propyl bromide composition consisting of 0.1–5% butylene oxide, 0.1–5.0% t-butanol, 0.1–5.0% Acetonitrile, and 0.1–5.0% nitromethane, with the remainder comprising of 1-bromopropane is effectively stable towards common metals used in industry. All percentages are by weight.

The highly preferred composition consists essentially of:

1% about 1% butylene oxide about 1.5% t-butanol about 1.5% acetonitrile about 0.5% nitromethane about 95.5% n-propyl bromide.

Many tests are available to evaluate the efficacy of stabilizers. The most typical is refluxing n-propyl bromide and the corresponding stabilizer packages with metal coupons for a given time. Changes in solvent color, coupon weight change or appearance have been used to rank prospective stabilizers.

EXAMPLE 1

Extensive testing of vapor-liquid equilibrium was carried out to identify azeotrope-like activity of n-propyl bromide and various components. Azeotropism was confirmed by distillation.

A 25×400 mm vacuum jacketed and silvered Hempel type distillation column was completely packed with 4×4 mm Raschig rings. The distillation column was setup with a 500 ml round bottom flask as a reboiler, a condenser, and reflux head and timer. The mixture to be tested was charged to the round bottom flask and heat applied. After refluxing a ½ hour cuts were started at a 5:1 reflux ratio. Approximately 50% of the charge was distilled overhead. The composition of the overhead components and the material remaining in the round bottom flask reboiler were compared and are summarized in Table 1.

EXAMPLE 2

Part 1

Initial tests are were performed to screen for potential stabilizers for n-propyl bromide. The test was similar to the blender test described in U.S. Pat. No. 4,018,837 to Archer et al. which is incorporated herein by reference, except 6.0 gm of Aluminum alloy 6061 was used with 100 ml solvent. Aluminum was used as a test standard for stabilization because it is very reactive towards halogenated solvents. It is assumed that if a formulation is relatively non-reactive with aluminum it will be relatively non-reactive with all metals.

The test was conducted for 10 minutes. The concentration of the stabilizer was 0.4%. The resulting blended aluminum and n-propyl bromide was transferred to a water bath at 115° F. They mixture was then watched for signs of reaction and the time noted.

Figure 1:
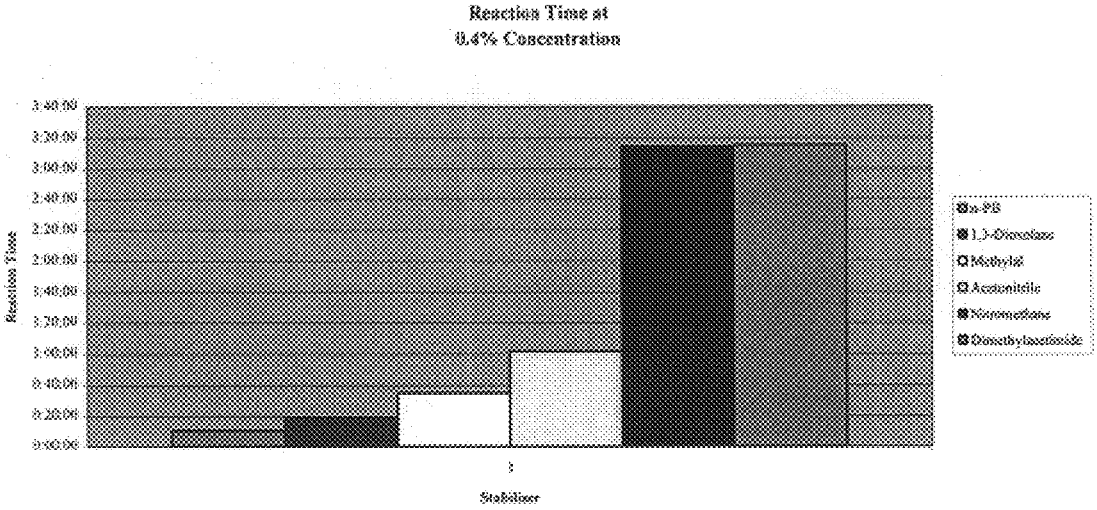
FIG. 1 is a chart of one set of tests showing the reaction time for various stabilizers at a concentration of 0.4% (wt./wt.).

The preliminary results are shown in FIG. 1 from which it can be seen that acetonitrile prevented signs of reaction three times longer than that of 1,3 dioxolane. 1,3-Dioxolane is an essential component of U.S. Pat. No. 5,665,172 to Oshima. It is also a primary stabilizer component used with 1,1,1-trichloroethane. Oshima essentially used the known stabilizer package for 1,1,1-trichloroethane for stabilizing n-propyl bromide. Hence, the stabilizing effect achieved by 1,3-dioxolane can be considered a benchmark.

Figure 2:
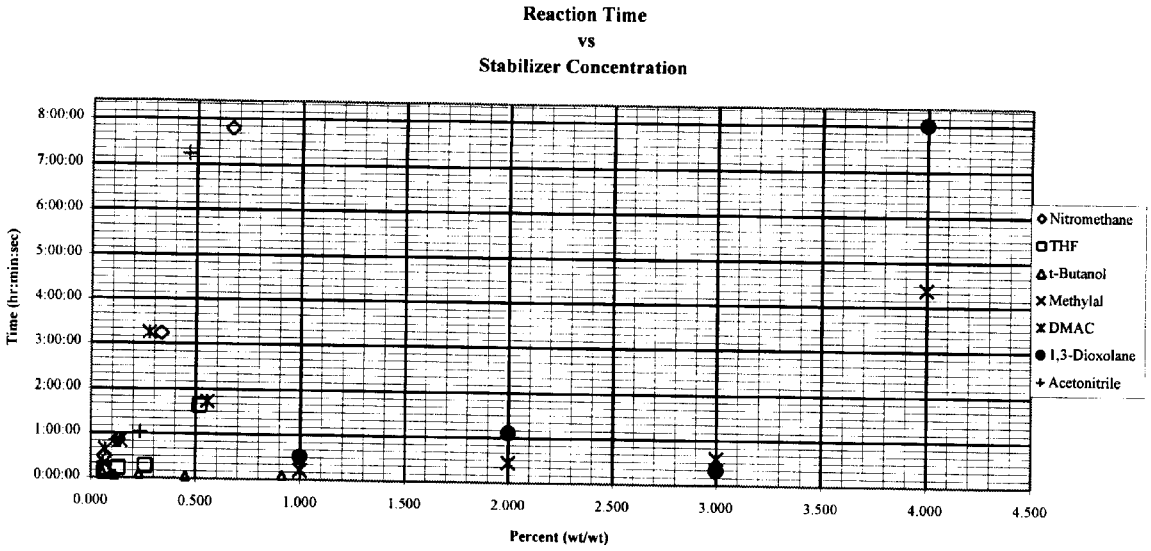
FIG. 2 is a chart of another set of tests showing the reaction time for various stabilizers at a various concentrations.

Another study by the inventor herein was performed to determine the effect of concentration of stabilizers on the reaction time of n-propyl bromide. The same test method was used. The results are shown in FIG. 2.

These tests show that acetonitrile outperforms 1,3-dioxolane in this "Blender"test. A concentration of 0.5% acetonitrile had a reaction time of 7 hours whereas 1,3-dioxolane was only 30 minutes.

TABLE 1

| | | | | | | | | AZEOTROPIC DATA | | | | |
|---|---|---|---|---|---|---|---|---|---|---|---|---|
| Component A | bp | Component B | bp | Component C | bp | Component D | bp | bp | % A | % B | % C | % D | 7p4311x1055 |
| n-Propyl Bromide | 71 | Butylene Oxide | 63 | | | | | NA | | | | | |
| n-Propyl Bromide | 71 | Butylene Oxide | 63 | Acetonitrile | 81 | Methylal | 42 | | | | | | |
| n-Propyl Bromide | 71 | Butylene Oxide | 63 | Acetonitrile | 81 | | | 67 | 82.5 | 3 | 14.5 | N/A | |
| n-Propyl Bromide | 71 | Butylene Oxide | 63 | Acetonitrile | 81 | THF | 66 | 67 | 79.1 | 2.6 | 14.5 | 3.8 | |
| n-Propyl Bromide | 71 | Butylene Oxide | 63 | Acetonitrile | 81 | t-Butanol | 83 | 67 | 77.9 | 2.2 | 11.5 | 8.4 | |
| n-Propyl Bromide | 71 | Butylene Oxide | 63 | Acetonitrile | 81 | 1,3-Dioxolane | 74 | 67 | 81.7 | 2.4 | 13.1 | 2.8 | |

bp = boiling point Centigrade

The stabilized n-propyl bromide can be used to effectively clean parts and components using a vapor degreaser or a cloth dampened with propyl bromide and wiped onto the part. Both techniques are used in industry.

For example, silver electrical connectors can be cleaned using the preferred formulation with exposure to boiling solvent in a vapor degreaser. In another example, aluminum seals contaminated with processing oils may be effectively cleaned in a vapor degreaser.

Each of the ingredients in the new formulation are liquids at room temperature. Simple mixing of the ingredients will result in a homogeneous mixture.

Part 2

The second phase of the tests performed was reflux testing. Since the formulation of this invention would be used in a vapor degreaser, which operates at the boiling point of the solvent, tests needed to be conducted under boiling conditions.

These tests were carried out by placing an aluminum and steel strip in refluxing solvent and watching for corrosion. The first test was performed on Abzol (Dipsol Chemicals), which is the trade name for the solvent formulation used in U.S. Pat. No. 5,665,172 to Oshima. The results of this testing are listed below.

| % | Comparative Stabilizer | ABZOL |
|---|---|---|
| 1.50 | Acetonitrile | Failed on |
| 1.50 | Methylal | Al |
| 0.50 | Nitromethane | |
| 1.00 | Butylene Oxide | |
| | | ABZOL |
| | 1 Days | 11 Days |
| | $Fe_{Black\ \&\ Br\ Spots}$ | No Fe Change |
| | $Al_{1\ Brown\ Spot}$ | $Al^{-Failed/Brown\ Cor.\ Line\ At\ interface}$ |

| % | Comparative Stabilizer |
|---|---|
| 0.00 | Acetonitrile |
| 1.50 | Methylal |
| 0.50 | Nitromethane |
| 1.00 | Butylene Oxide |
| 1 Days | |
| $Fe_{Failed\text{-}Brown\ Spots}$ | |
| $Al_{Failed\text{-}Brown\ Spots}$ | |

| % | Comparative Stabilizer | % | Comp. Stabilizer | % | Invention Stabilizer |
|---|---|---|---|---|---|
| 1.00 | Acetonitrile | 0.50 | Acetonitrile | 1.50 | Acetonitrile |
| 1.50 | THF | 0.50 | THF | 1.50 | t-Butanol |
| 1.00 | Butylene Oxide | 0.25 | t-Butanol | 0.50 | Nitrometh. |
| | | 0.50 | Butylene Oxide | 1.00 | Butylene Oxide |
| 10 Days | | 10 Days | | 10 Days | |
| $Fe_{Failed\ 10\ overlapping\ Br\ spots}$ | | $Fe_{Failed\ Heavy\ Corrosion}$ | | $Fe^{N/C\ "Powder\ Line"}$ | |
| $Al_{Failed\text{-}1\ pit\ 3\ water\ spots}$ | | $Al_{Failed\ Heavy\ Corrosion}$ | | $Al^{N/C\ "Powder\ Line"}$ | |
| | | | | PASSED | |

| % | Stabilizer | % | Stabilizer | % | Stabilizer |
|---|---|---|---|---|---|
| 1.50 | Acetonitrile | 1.00 | Acetonitrile | 1.50 | Acetonitrile |
| 1.50 | t-Butanol | 1.00 | t-Butanol | 0.75 | t-Butanol |
| 1.00 | Butylene Oxide | 1.00 | Butylene Oxide | 0.50 | Nitromethane |
| | | | | 1.00 | Butylene Oxide |
| 3 Days | | 10 Days | | 10 Days | |
| Fe/Al-Failed | | Fe/Al-Failed | | Fe/Al-Failed | |

What is claimed is:

1. A cleaning composition consisting essentially of:

about 0.1 to 5% Butylene oxide;

about 0.1 to 5.0% t-butanol about 0.1 to 5% acetonitrile about 0.1 to 5% nitromethane; and the remainder n-propyl bromide.

2. A cleaning composition consisting essentially of:

about 1% Butylene oxide;

about 1.5% t-butanol;

about 1.5% acetonitrile;

about 0.5% nitromethane; and about 95.5% n-propyl bromide.

3. A method of cleaning a surface of an article, which comprises the steps of:

contacting the surface of the article with the composition of claim 1 in an amount effective to accomplish said cleaning.

4. A method of cleaning a surface of an article, which comprises the steps of:

contacting the surface of the article with the composition of claim 2 in an amount effective to accomplish said cleaning.

* * * * *